United States Patent [19]

Jikka et al.

[11] Patent Number: 4,842,689

[45] Date of Patent: Jun. 27, 1989

[54] METHOD FOR CONTROLLING SULPHITE PULPING AND HYDROLYTIC PROCESSES BY MEANS OF RAPID FURFURAL ANALYZER

[75] Inventors: Panu O. Jikka; Nils-Erik Virkola, both of Helsinki, Finland

[73] Assignee: Oy Advanced Forest Automation Ab, Finland

[21] Appl. No.: 93,102

[22] Filed: Sep. 1, 1987

Related U.S. Application Data

[63] Continuation of Ser. No. 745,910, Jun. 18, 1985, abandoned.

[30] Foreign Application Priority Data

Jun. 20, 1984 [FI] Finland ..... 842488

[51] Int. Cl.[4] ..... D21C 3/04; D21C 3/06; D21C 7/12

[52] U.S. Cl. ..... 162/49; 162/61; 162/83

[58] Field of Search ..... 162/16, 49, 50, 238, 162/198; 436/161, 164, 129, 94, 175; 210/662

[56] References Cited

U.S. PATENT DOCUMENTS 4,086,129 4/1978 Conca et al. ..... 162/49
4,540,468 9/1985 Genco et al. ..... 162/49

FOREIGN PATENT DOCUMENTS 69132 1/1986 Finland .

OTHER PUBLICATIONS

Haglund et al., "Spectrophotometric Determination of the Dissolution of Lignin During Sulphite Cooking"; *TAPPI,* May 1964, vol. 47, No. 5, pp. 286–291.
Felicetta et al., "Spent Sulphite Liquor VII," TAPPI, vol. 42, No. 6, Jun. 1959.

*Primary Examiner*—Steve Alvo
*Attorney, Agent, or Firm*—Scully, Scott, Murphy & Presser

[57] ABSTRACT

A method of controlling sulphite pulping or hydrolytic processes by means of a rapid furfural analyzer. Furfural and 5-hydroxymethylfurfural are separated from the other UV-absorbing compounds of a process liquor sample. The concentration measurements are carried out by menas of an UV-method. The obtained measuring results are utilized for on-line controlling of the process in question.

4 Claims, 2 Drawing Sheets

ANALYSIS OF A SULPHITE COOKING LIQUOR SAMPLE FOR THE LIGNIN, TOTAL SULPHUR DIOXIDE AND FURFURAL THEREOF BY MEANS OF AN AUTOMATIC ANALYZER

ANALYSIS OF A SULPHITE COOKING LIQUOR SAMPLE FOR THE LIGNIN, TOTAL SULPHUR DIOXIDE AND FURFURAL THEREOF BY MEANS OF AN AUTOMATIC ANALYZER

CALIBRATION CURVE
RELATIVE FURFURAL CONCENTRATION OF THE ANALYZER AS A STANDARD SAMPLES WEIGHED

OBSERVATION OF SULPHITE PULPING (BLACK COOK) DESTRUCTION BY MEANS OF FURFURAL ANALYSIS

DEVELOPMENT OF XYLOSE CONCENTRATION OF A PREHYDROLYSIS AS A FUNCTION OF FURFURAL CONCENTATION

METHOD FOR CONTROLLING SULPHITE PULPING AND HYDROLYTIC PROCESSES BY MEANS OF RAPID FURFURAL ANALYZER

This application is a continuation of application Ser. No. 745,910, filed June 18, 1985, now abandoned.

The invention relates to a method, by means of which the furfural concentration in a process liquor can be rapidly measured, the obtained information being used for controlling an on-line process.

In acid sulphite pulping, the concentration of the so called bound sulphur dioxide in the cooking acid, i.e. the sulphur bound to the cooling alkali (Na, CA, Mg, $NH_4^+$), is of crucial importance, which concentration, as an analysis of the acid, thus simultaneously acts as a measure of the amount of the cooking cation. If the amount of the bound sulphur dioxide in digestion is insufficient, the strongly acidic lignosulphonic acids formed during digestion cannot occur in the form of their salts of the cooking cation in the solution, but free sulphonic acids are formed, which rapidly destroy the cook by effecting condensation of lignin and by splitting the cellulose so that it is of use. A so called black cook is formed, whereby the wood material will be destroyed. By means of modern technology, it is not possible to anticipate a black cook during the digestion process, but the only precaution to be taken is so try to make the cooking acid so good that no difficulties will arise. However, the risk of black cook always exists when the digester is filled with wood of high density, e.g. beechwood. Black cook can also result from deficient absorption of the cooling liquor or an excessively high temperature. The only way of observing a black cook is the tarlike black contour of the cooking liquor, which can be seen only after the damage has already occurred.

With regard to controlling sulphite pulping, it has now been discovered that by observing the increase in the furfural concentration, a warning of the formation of black cook can be obtained as early as about 100 minutes before the rapid destruction of the cook. This is due to the fact that the protons released in the pulping liquor by free lignosulphonic acids catalyze conversion of the monosaccharides split from wood polysaccharides to furfural. This it is possible to observe the consumption and that the amount of the inorganic cooking chemical portion will be sufficient by means of organochemical furfural analysis. When a warning has been received, the cooking conditions can be altered or fresh cooking acid having a high concentration of bound sulphur dioxide can be added, said acid being always available in the production of acid. "Saving" of the cook is of great economical importance, as the final product of a black cook cannot be further utilized.

The method according to the invention for controlling sulphite pulping is characterized by separating furfural and 5-hydroxymethylfurfural from the other UV-absorbing compounds contained in a column filled with a cation exchange material, whereby the cation exchange material used is styrene divinylbenzene resin, in which functional ionizable groups are sulphonic acid groups and the particle size of which is 100 to 200 mesh or 200 to 400 mesh, and in which the degree of cross-linking is appropriate to the absorption separation of the furfural and the 5-hydroxymethylfurfural, i.e. the resin contains 4 to 5% divinylbenzene, and carrying out the concentration measurement from the liquor flow coming out from the exclusion column by means of an UV-method at a wave length of 280 nm, and adjusting the cooking temperature on the basis of the measuring results obtained in a manner known per se or adding fresh cooking acid containing large quantities of bound sulphur dioxide.

The separation of furfural from a cooking liquor sample is based on absorption processes between the furfural and the molecular backbone of the cation exchange resin, said processes being particularly useful when the resin cross-linking degree is 4% divinylbenzene, i.e. with a so called x4 resin. The other cross-linking degrees, 2 and 8% divinylbenzene do not provide a proper analysis: the furfural zone either covers the other cooking liquor components to be analysed or it is too slow, the shape of the peak being poor.

No literature has been found concerning the use of rapid measurement of furfural concentration for process control.

Figure 1:
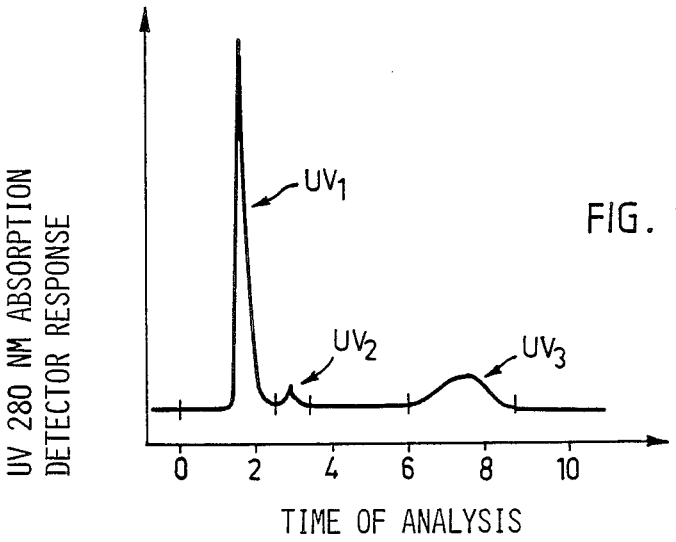
FIG. 1 illustrates UV measurements of a sulfite cooking liquor from the final stage of a cook.

In the present invention, the furfural concentration was measured by means of an apparatus for analysing cooking liquors, said apparatus being disclosed in Finnish Pat. No. 069,132 (equivalent to U.S. Pat. No. 4,178,979) and Finish Patent Application No. 834,870 (equivalent to U.S. Patent Application Ser. No. 673,479, filed Nov. 20, 1984 and now abandoned).

It is particularly advantageous to use the present invention in combination with the inventions according to the above-mentioned patent applications. By means of said methods, the worst defects of the control of sulphite pulping can be remedied, i.e. information is obtained on the concentration of the total sulphur dioxide or the cooking chemical, on the concentration of the lignin dissolved from wood as a result of the digestion reaction and on the rate of absorption; besides, a warning is obtained of the possible destruction of the cook, i.e. of a useless black cook.

A similar kind of observation and controlling is extremely useful also in hydrolytic processes, in which protons catalyzing the hydrolysis also effect conversion of monosaccarides to furfural. Because the strength of the hydrolysis, as well as the formation of furfural, is determined on the basis of the acid concentration and the hydrolysis temperature, the formation of furfural, i.e. increase in the concentration thereof, is a measure of the strength and proceeding of the hydrolysis. It is especially useful to observe the strength of the hydrolysis in a prehydrolysis sulphate pulping process, in which xylan is removed from wood in the form of xylose in the prehydrolysis, and thereafter the hydrolysed wood material is cooked by means of a sulphate method to a dissolving pulp by high quality. In this method, the strength of the prehydrolysis must not be too high, because otherwise the wood material, lignin in particular, is damaged and cannot be pulped any more. Said damaging is similar to that occurring in sulphite digestion processes if bound $SO_2$ runs short. Thus, the prehydrolysis can be controlled so that an optimum final product is obtained by means of one furfural measurement.

The prior art does not disclose any methods of controlling a prehydrolysis by means of measurement based on process chemistry.

The method according to the invention for controlling hydrolytic processes is characterized by separating furfural and 5-hydroxymethylfurfural from the other UV-aborbing compounds contained in a column filled with a cation exchange material, whereby the cation exchange material used is styrene divinylbenzene resin, in which functional ionizable groups are sulphonic acid groups and the particle size of which is 100 to 200 mesh or 200 to 400 mesh, and in which the degree of cross-linking is appropriate to the absorption separation of the furfural and the 5-hydroxymethylfurfural, i.e. the resin contains 4 to 5% divinylbenzene and carrying out the concentration measurements of the two groups from the liquor flow coming out from the exclusion column by means of an UV-method at a wave length of 280 nm, and deciding on the basis of the obtained measuring results when the hydrolysis must be stopped.

In addition, it is also possible according to the invention to observe the proceeding of a conventional wood hydrolysis, which is otherwise impossible by means of an on-line technique on account of the formation of sugar. It is also obvious to use the method according to the invention in furfural plants where furfural is produced from wood at a high temperature.

EXAMPLE 1

30 μl calcium sulphite cooking liquor from the final stage of a cook was introduced into an ion exclusion column having a diameter of 10 mm and a length of 21 cm, the ion exclusion material of which column was a $Ca^{2+}$-shaped Bio-Rad AG50Wx4 200–400 mesh cation exchange resin and which was eluted with pure gasfree water 3.6 ml/min at a temperature of 60° C. The furfural concentration was determined by using a device called Knaver UV-filterpkotometer and a flow-through 0.4 mm cuvette as a detector, the measurement being carried out at a wave length of 280 nm. The result curve of the measurement is shown in FIG. 1, wherein $UV_1$ is lignosulphonate, $UV_2$ is total sulphur dioxide, the third absorption zone $UV_3$ being the furfural of the pulping liquor sample.

Figure 2:
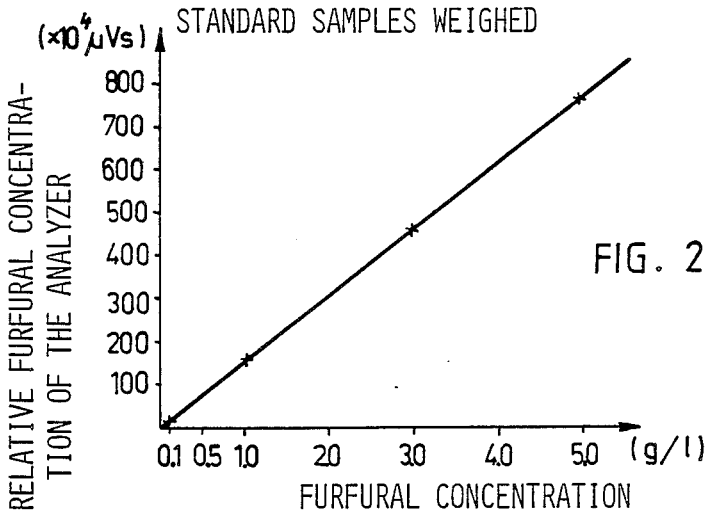
FIG. 2 illustrates a calibration curve produced by weighed functional standards.

The concentration results of the analysis was obtained by integrating the surface area of the concentration zones with regard to time by means of an automatic integrator. FIG. 2 shows a calibration curve produced by means of weighed furfural standards, which curve is fully linear, thus proving the usability of the analysis.

EXAMPLE 2

Figure 3:
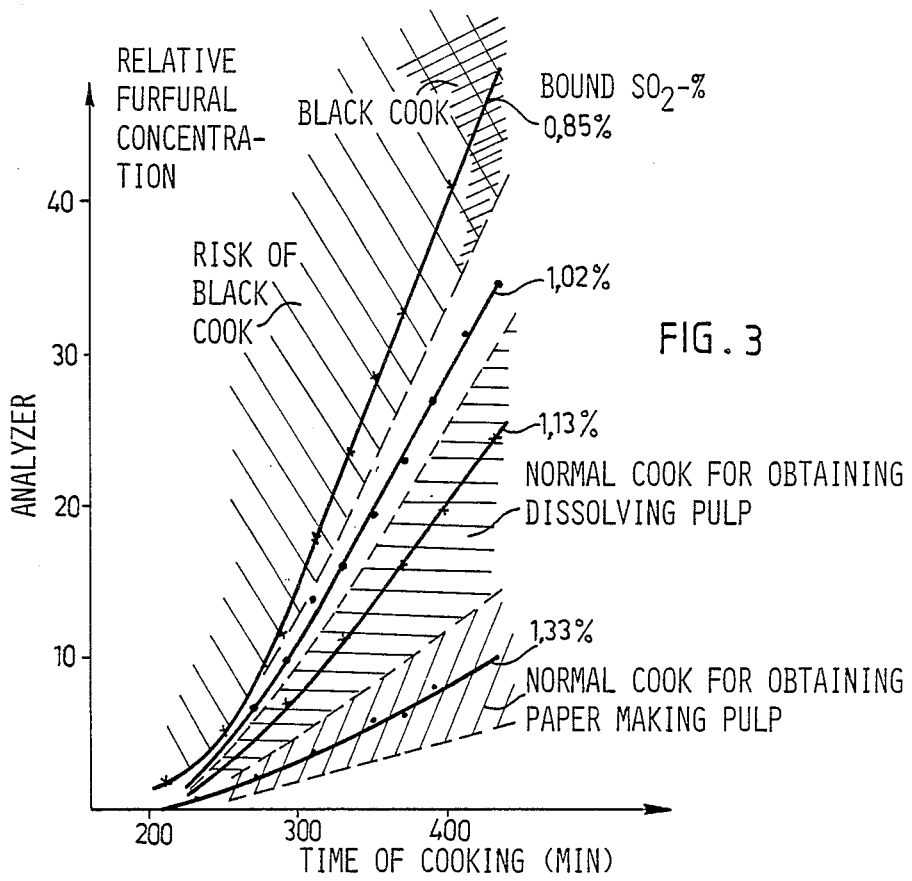
FIG. 3 illustrates curves and areas in which normal and black cooks occur.

Identical sulphite cooks, in which only the amount of bound sulphur dioxide in the cooking acid was altered, were cooked in a forced circulation digester of 20 l. The furfural concentration was observed every 20 minutes by means of an automatic analyzer, which is disclosed in Finnish Pat. No. 064,132. FIG. 3 shows curves and areas in which normal and black cooks occur. It appears from FIG. 3 that a low concentration of bound $SO_2$ results in a very rapid increase in the furfural concentration, which process gets started already with a cooking time of 240 minutes. So it is possible to point out the curve illustrative of the situation in each particular case as early as 100 minutes before the final destruction of the digestion to a black cook on the curve bound $SO_2$ 0.85 %, time 400 minutes. The curves with bound $SO_2$ 1.13 and 1.33 % led to normal pulp of high quality.

EXAMPLE 3

Figure 4:
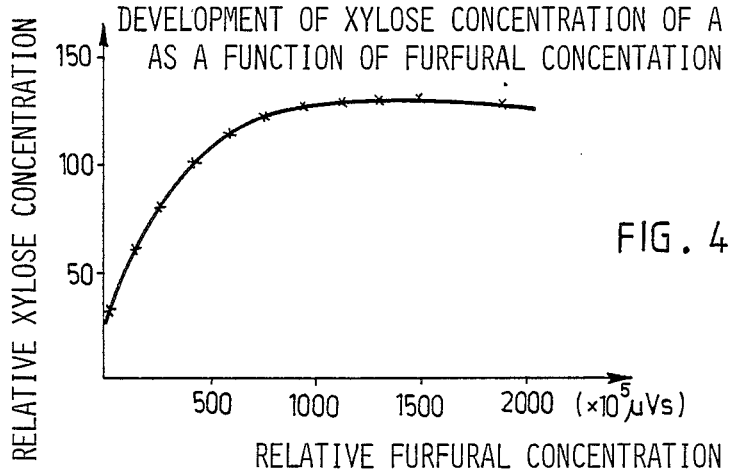
FIG. 4 illustrates the development of xylose concentration as a function of furfural concentration.

A $SO_2$ (0.25 % from wood) -hydrolysis was carried out at a temperature of 165° C. and with a cooking time of 160 minutes. The furfural concentration of the hydrolysis solution was observed as in Example 2. FIG. 4 shows the development of the xylose concentration of a birch prehydrolysis as a function of the furfural concentration. It is clearly seen that the formation of xylose in the hydrolysis reaches a distinictive maximum value approximately with the relative furfural concentration of 1000 to 1200, beyond which hydrolysation does not any more increase the xylose concentration but solely the furfural concentration, which is very disadvantages in view of the cooking process following the hydrolysis. It is thus possible to stop the prehydrolysis when the xylose yield is optimally highest and the quality of the final cellulose product the best possible.

What is claimed is:

1. A method for controlling sulphite pulping comprising (a) separating furfural and 5-hydroxymethylfurfural from the other UV-absorbing compounds contained in a sulphite cooking liquor under absorption separation conditions in a cation exchange resin;

(b) determining the content of furfural and 5-hydroxymethylfurfural of the sulphite cooking liquor by UV light analysis at 280 nm; and (c) controlling the pulping of wood with a sulphite cooking liquor at a cooking temperature by adjusting the cooking temperature or adding fresh cooking liquor having a high degree of bound sulfur dioxide in order to obtain a desired furfural content or a desired cellulose viscosity based upon the previously determined content of furfural and 5-hydroxymethylfurfural.

2. The method of claim 1 wherein the cation exchange resin is divinylbenzene resin in which the functional ionizable groups are sulphonic acid groups and the particle size of which is 100 to 400 mesh and in which the degree of cross-linking is appropriate for the absorption separation of furfural and 5-hydroxymethylfurfural, said resin containing 4 to 5% divinylbenzene.

3. A method for controlling $SO_2$ hydrolytic wood processes comprising (a) separating furfural and 5-hydroxymethylfurfural from the other UV-absorbing compounds contained in a sulphite cooking liquor under absorption separation conditions in a cation exchange resin;

(b) determining the content of said furfural and said 5-hydroxymethylfurfural by UV light analysis at 280 nm; and (c) hydrolyzing wood with an $SO_2$ containing solution and terminating hydrolysis when the desired furfural content is obtained.

4. The method of claim 3 wherein the cation exchange resin is divinylbenzene resin in which the functional ionizable groups are sulphonic acid groups and the particle size of which is 100 to 400 mesh and in which the degree of cross-linking is appropriate for the absorption separation of furfural and 5-hydroxymethylfurfural, said resin containing 4 to 5% divinylbenzene.

* * * * *

UNITED STATES PATENT AND TRADEMARK OFFICE

CERTIFICATE OF CORRECTION

PATENT NO. : 4,842,689

DATED : June 27, 1989

INVENTOR(S) : Panu O. Tikka, et al.

It is certified that error appears in the above-identified patent and that said Letters Patent is hereby corrected as shown below:

On the Title page, section [75]: "Panu O. Jikka" should read as --Panu O. Tikka--

Column 1, line 14: "cooling" should read as --cooking--

Column 1, line 28: "so" should read as --to--

Column 1, line 33: "cooling" should read as --cooking--

Column 1, line 35: "contour" should read as --colour--

Column 1, line 46: "This" should read as --Thus--

Column 3, line 60: "064,132" should read as --069,132--

Column 4, line 12: "distinictive" should read as --distinctive--

Signed and Sealed this

Fourth Day of September, 1990

*Attest:*

*Attesting Officer*

HARRY F. MANBECK, JR.

*Commissioner of Patents and Trademarks*